US011830385B2

(12) United States Patent
Castillo

(10) Patent No.: US 11,830,385 B2
(45) **Date of Patent: *Nov. 28, 2023**

(54) APPARATUS AND METHODOLOGY FOR CUSTOMIZING VEHICLE SIGNAGE

(71) Applicant: Samuel Castillo, El Paso, TX (US)

(72) Inventor: Samuel Castillo, El Paso, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/092,108

(22) Filed: Dec. 30, 2022

(65) Prior Publication Data

US 2023/0147753 A1 May 11, 2023

Related U.S. Application Data

(63) Continuation of application No. 17/105,273, filed on Nov. 25, 2020, now Pat. No. 11,545,055.

(60) Provisional application No. 62/940,803, filed on Nov. 26, 2019.

(51) Int. Cl.

| | |
|---|---|
| ***G09F 13/00*** | (2006.01) |
| ***G09F 21/04*** | (2006.01) |
| ***G09F 13/22*** | (2006.01) |
| *G09F 13/04* | (2006.01) |

(52) U.S. Cl.

CPC ..... *G09F 13/005* (2013.01); *G09F 13/22* (2013.01); *G09F 21/041* (2020.05); *G09F 13/044* (2021.05); *G09F 2013/222* (2013.01)

(58) Field of Classification Search

CPC .. G09F 13/04; G09F 13/044; G09F 2013/222; G09F 21/041

See application file for complete search history.

(56) References Cited

U.S. PATENT DOCUMENTS

| | | | | |
|---|---|---|---|---|
| 4,557,517 | A * | 12/1985 | Bolduc | B62D 35/001 362/253 |
| 5,082,703 | A * | 1/1992 | Longobardi | B44F 1/00 428/38 |
| 6,042,888 | A * | 3/2000 | Sismanis | B44F 1/04 427/256 |
| 6,094,849 | A * | 8/2000 | Phillips | G02B 6/0095 40/546 |
| 9,015,972 | B1 * | 4/2015 | Morgan | G09F 21/048 40/591 |
| 9,440,597 | B1 * | 9/2016 | Broadwell | B60R 13/105 |
| 9,651,215 | B1 * | 5/2017 | Britten | G09F 13/04 |
| 9,945,539 | B1 * | 4/2018 | Su | A47G 1/0622 |
| 10,539,807 | B1 * | 1/2020 | Weinstock | G02F 1/133514 |
| 2004/0154199 | A1 * | 8/2004 | Robinson | G09F 13/04 40/544 |

(Continued)

*Primary Examiner* — Gary C Hoge

(74) *Attorney, Agent, or Firm* — LOZA & LOZA, LLP; Daniel Castro

(57) ABSTRACT

Aspects are disclosed that facilitate customizing vehicle signage. In a particular aspect, a signage is disclosed which includes a mica cover positioned within the perimeter of a frame. The signage further includes a light source configured to direct light towards a backside of the mica cover, and a logo component positioned on the backside of the mica cover. In a particular aspect, the light source is configured to illuminate a logo by transmitting light through the logo component so that the illuminated logo is viewable from the frontside of the mica cover. An attachment mechanism is also included, which is configured to attach the signage to a vehicle.

20 Claims, 8 Drawing Sheets

(56) References Cited

U.S. PATENT DOCUMENTS

| | | | | |
|---|---|---|---|---|
| 2009/0211130 | A1* | 8/2009 | Hoffman | G09F 13/22 362/249.02 |
| 2009/0220750 | A1* | 9/2009 | Hill | B44F 1/04 216/45 |
| 2012/0304513 | A1* | 12/2012 | Gorelick | G09F 13/18 40/606.19 |
| 2014/0026451 | A1* | 1/2014 | Gillespie | G09F 13/04 40/578 |
| 2014/0268785 | A1* | 9/2014 | Quaal | G09F 13/22 362/249.08 |
| 2015/0107142 | A1* | 4/2015 | Burrous | G09F 13/18 40/714 |
| 2015/0364066 | A1* | 12/2015 | Djafer | G09F 13/16 40/559 |
| 2018/0259762 | A1* | 9/2018 | Fujimoto | G01N 21/6428 |

* cited by examiner

APPARATUS AND METHODOLOGY FOR CUSTOMIZING VEHICLE SIGNAGE

CROSS-REFERENCE TO RELATED APPLICATIONS

This application is a continuation of U.S. patent application Ser. No. 17/105,273, filed Nov. 25, 2020, entitled "APPARATUS AND METHODOLOGY FOR CUSTOMIZING VEHICLE SIGNAGE," which claims the benefit of U.S. Provisional Patent Application Ser. No. 62/940,803, filed Nov. 26, 2019, entitled "APPARATUS AND METHODOLOGY FOR CUSTOMIZING VEHICLE SIGNAGE", wherein the entire contents of each of the aforementioned patent applications are hereby expressly incorporated by reference.

TECHNICAL FIELD

The subject disclosure generally relates to signage, and more specifically to an apparatus and methodology for customizing vehicle signage.

INTRODUCTION

By way of background concerning conventional vehicle signage, it is noted that commercial passenger transportation (e.g., busses, vans, etc.) is a multi-million dollar industry, wherein signage is used for any of a plurality of applications. For instance, vehicle signage is often used for advertising where such advertisements target passengers, as well as people from the general public. Indeed, since motor coaches are mobile, external signage provides a unique advertising opportunity to reach anyone that might see the motor coach along its route.

Vehicle signage is also used often to personalize a motor coach chartered for a particular group. Personalizing a motor coach with signage may be desirable for any of various reasons. For instance, a school may charter a bus for a school-related trip, wherein personalizing the bus with the school's mascot provides students, teachers, etc. with a sense of pride. Also, since such trips will often include different schools traveling to the same destination on different busses, personalizing a bus with school-specific signage makes it easier for passengers to find their bus.

Whether with respect to advertising and/or personalizing, however, several challenges exist with conventional vehicle signage methods. For instance, such signage is often difficult to view at night when there is dim light. Also, replacing the content of such signage from one advertising campaign to another often requires much labor and expense.

Currently, there is thus no effective solution to address at least these specific problems with conventional vehicle signage methods. Accordingly, it would be desirable to provide an apparatus and methodology which overcomes these limitations. To this end, it should be noted that the above-described deficiencies are merely intended to provide an overview of some of the problems of conventional systems, and are not intended to be exhaustive. Other problems with the state of the art and corresponding benefits of some of the various non-limiting embodiments may become further apparent upon review of the following detailed description.

SUMMARY

A simplified summary is provided herein to help enable a basic or general understanding of various aspects of exemplary, non-limiting embodiments that follow in the more detailed description and the accompanying drawings. This summary is not intended, however, as an extensive or exhaustive overview. Instead, the sole purpose of this summary is to present some concepts related to some exemplary non-limiting embodiments in a simplified form as a prelude to the more detailed description of the various embodiments that follow.

In accordance with one or more embodiments and corresponding disclosure, various non-limiting aspects are described in connection with customizing vehicle signage. In one such aspect, a signage is disclosed which includes a frame, a mica cover, a light source, a logo component, and an attachment mechanism. Within such embodiment, the mica cover is positioned within a perimeter of the frame, and the light source is configured to direct light towards a backside of the mica cover. Furthermore, the logo component is positioned on the backside of the mica cover, in which the light source is configured to illuminate a logo by transmitting light through the logo component so that the illuminated logo is viewable from the frontside of the mica cover. The attachment mechanism is then configured to attach the signage to a vehicle.

Other embodiments and various non-limiting examples, scenarios and implementations are described in more detail below.

BRIEF DESCRIPTION OF THE DRAWINGS

Various non-limiting embodiments are further described with reference to the accompanying drawings in which.

DETAILED DESCRIPTION

Overview

Figure 1:
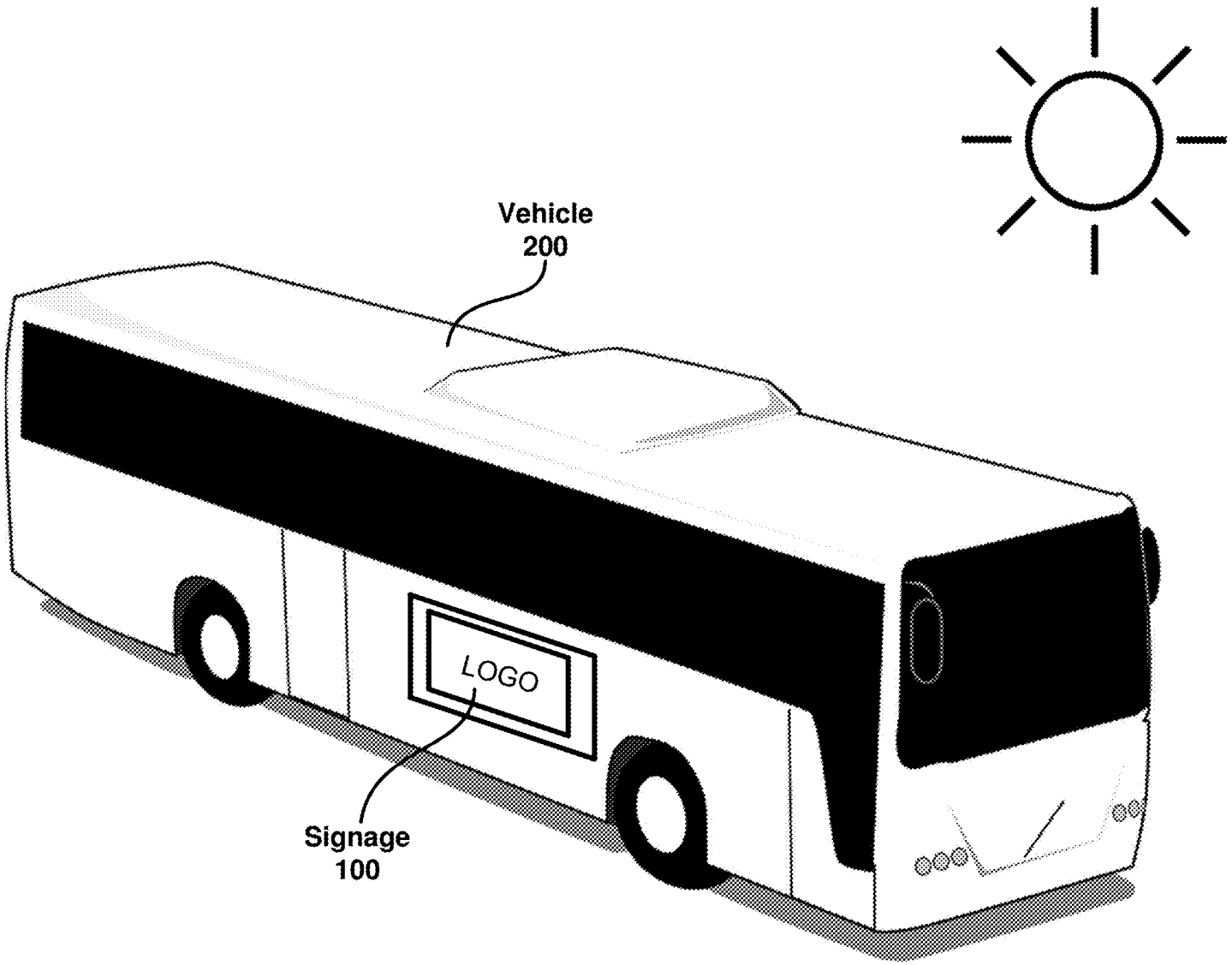
FIG. 1 illustrates an exemplary vehicle signage during day time use in accordance with an aspect of the subject specification.
Figure 2:
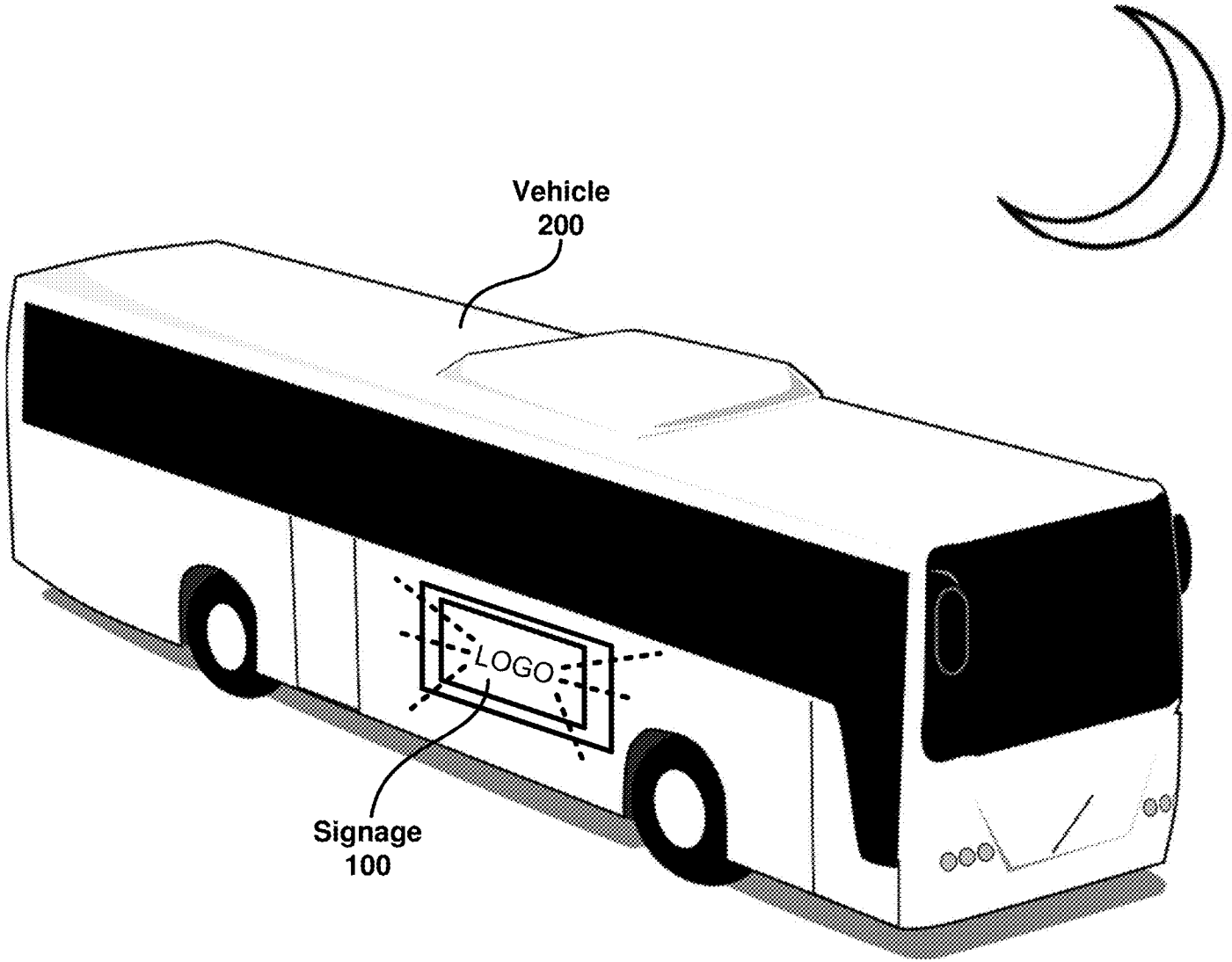
FIG. 2 illustrates an exemplary vehicle signage during night time use in accordance with an aspect of the subject specification.

As discussed in the introduction, it would be desirable to address the specific problem of making vehicle signage more viewable when ambient light is dim and making the content of such signage more readily replaceable. The various embodiments disclosed herein are directed towards overcoming these limitations by providing a replaceable vehicle signage apparatus configured with a lighting mechanism. An exemplary embodiment of the vehicle signage apparatus disclosed herein is illustrated in FIGS. 1-2, wherein the signage 100 is configured to attach to a vehicle 200, as shown. Here, it is contemplated that the signage 100 may be configured to attach to the vehicle 200 via any of various attachment mechanisms including mechanisms in which the signage 100 may be readily attached and removed from the vehicle 200 (e.g., a magnetic mechanism). Alternatively, rather than removing the entire signage 100, aspects disclosed herein include embodiments in which the logo displayed on the signage 100 may be readily replaced while the signage 100 remains attached to the vehicle 200.

It is also contemplated that the signage 100 may be configured to include any of various lighting mechanisms. In an exemplary embodiment, it is thus contemplated that a logo displayed on the signage 100 may be viewable both in the daytime, as illustrated in FIG. 1, and at night when there is less ambient light, as illustrated in FIG. 2.

Exemplary Vehicle Signage Embodiments

Figure 3:
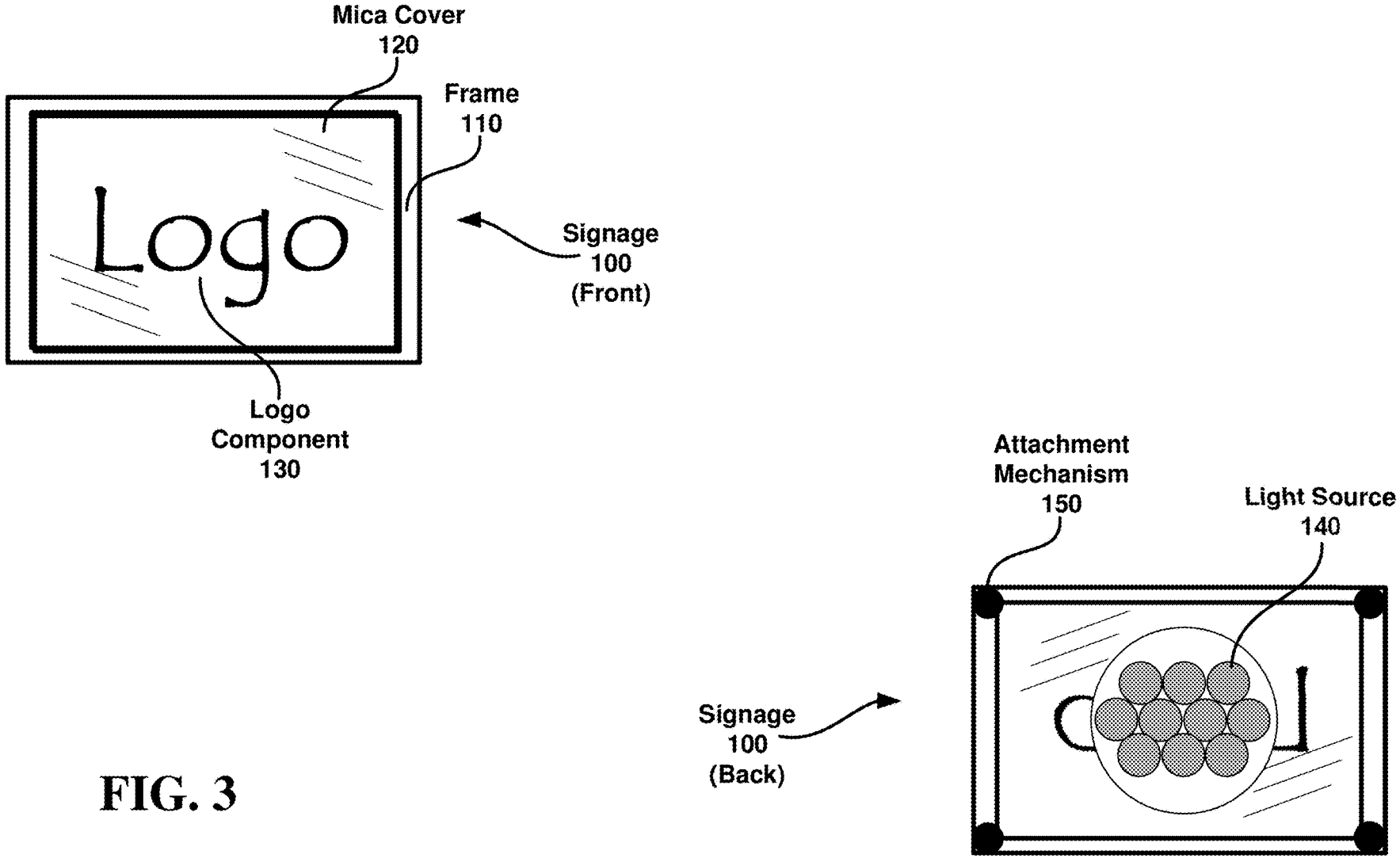
FIG. 3 illustrates a front and back view of an exemplary signage in accordance with an aspect of the subject specification.

Turning now to FIGS. 3-8, various exemplary embodiments of the vehicle signage apparatus disclosed herein are provided. In FIG. 3, for example, a front and back view of an exemplary signage in accordance with an aspect of the subject specification is provided. As illustrated, it is contemplated that signage 100 may be configured to include a frame 110 and a mica cover 120 (e.g., comprising polycarbonate material) positioned within a perimeter of the frame 110. Here, it should be appreciated that, although the frame 110 is illustrated in a rectangular configuration, the frame 110 may be configured in any of a plurality of different shapes (e.g., circular, triangular, etc.). It is further contemplated that the signage 100 may also include a light source 140 (e.g., a light emitting diode (LED) light source) and a logo component 130 positioned on a backside of the mica cover 120. Within such embodiment, the light source 140 may be configured to direct light towards the backside of the mica cover 120, wherein the light source 140 is configured to illuminate a logo by transmitting light through the logo component 130 such that the illuminated logo is viewable from the frontside of the mica cover 120. Here, because of the optical properties of mica material, it is contemplated that light provided by the light source 140 may be absorbed by the mica cover 120, which would make the logo on the logo component 130 more viewable (e.g., at night). As illustrated, it is also contemplated that the signage 100 may further include an attachment mechanism 150 (e.g., a magnetic mechanism) configured to attach the signage 100 to a vehicle (e.g., vehicle 200).

Figure 4:
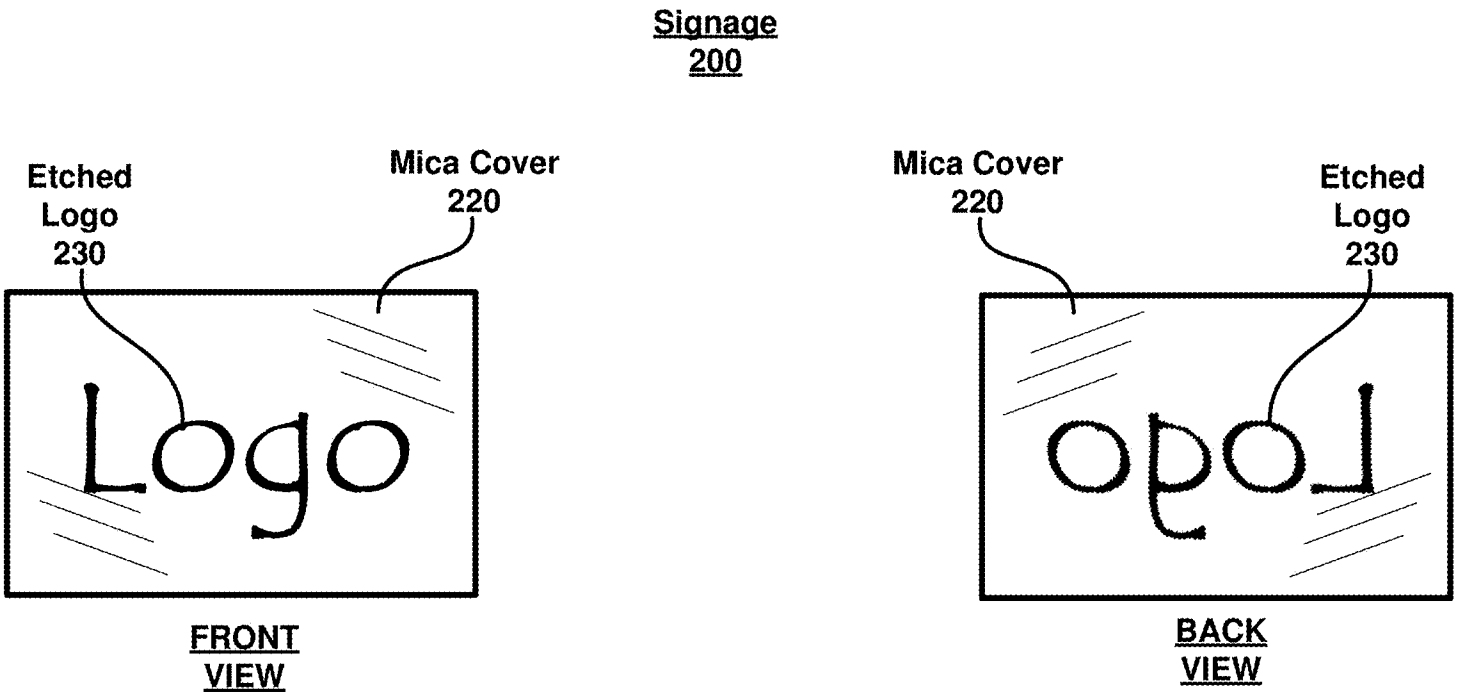
FIG. 4 illustrates an exemplary etched logo in accordance with an aspect of the subject specification.

Referring next to FIG. 4, an illustration is provided of an exemplary vehicle signage embodiment which includes an etched logo in accordance with an aspect of the subject specification. As illustrated, a signage 200 is contemplated in which the signage 200 comprises a mica cover 220 and an etched logo 230, wherein the mica cover 220 is substantially similar to mica cover 120, and wherein the etched logo 230 is a particular embodiment of logo component 130. Moreover, it is contemplated that the logo component 130 may be implemented as an etching of the logo 230 on the backside of the mica cover 220. Within such embodiment, it is further contemplated that the etched logo 230 may comprise translucent ink to facilitate transmitting light (e.g., from light source 140) through the etched logo 230 and absorbed by the mica cover 220, which results in an illumination of the etched logo 230.

Figure 5:
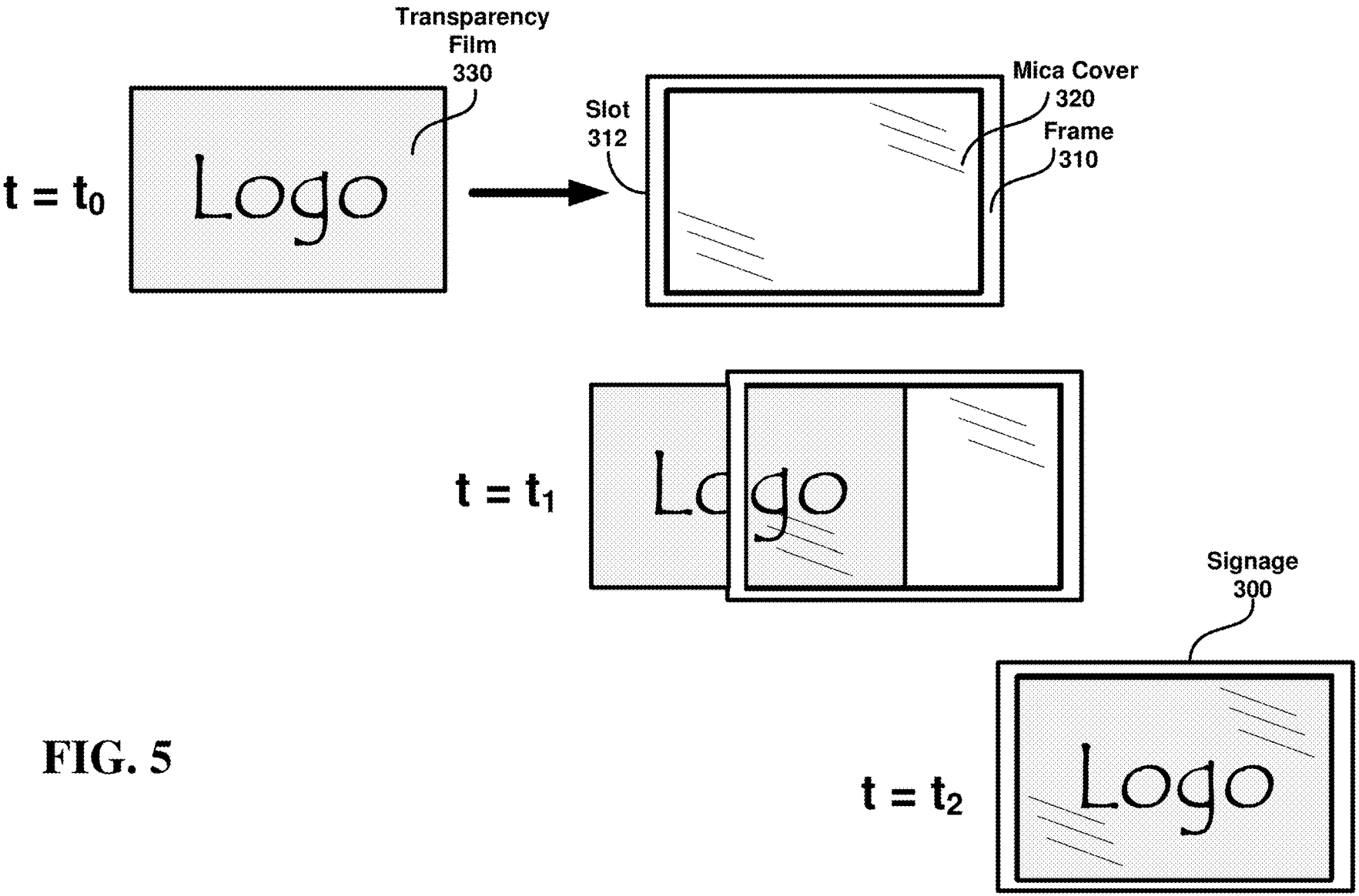
FIG. 5 is a time lapse illustrating an exemplary logo insertion in accordance with an aspect of the subject specification.

Referring next to FIG. 5, a time lapse is provided illustrating an exemplary logo insertion in accordance with an aspect of the subject specification. As illustrated, a signage 300 is contemplated in which the signage 300 comprises a frame 310 with a slot 312 configured to receive a transparency film 330. Within such embodiment, it is further contemplated that the signage 300 includes a mica cover 320 substantially similar to mica cover 120, wherein the transparency film 330 is a particular embodiment of logo component 130. Moreover, it is contemplated that the transparency film 330 may be inserted via the slot 312 in order to position the transparency film 330 on the backside of the mica cover 320. Within such embodiment, a logo printed on the transparency film 330 may thus be illuminated by transmitting light (e.g., from light source 140) through the transparency film 330 which is then absorbed by the mica cover 320. If a logo replacement is desired, rather than replacing the entire signage 300, a user may simply remove the transparency film 330 and replace with another with the desired replacement logo.

Figure 6:
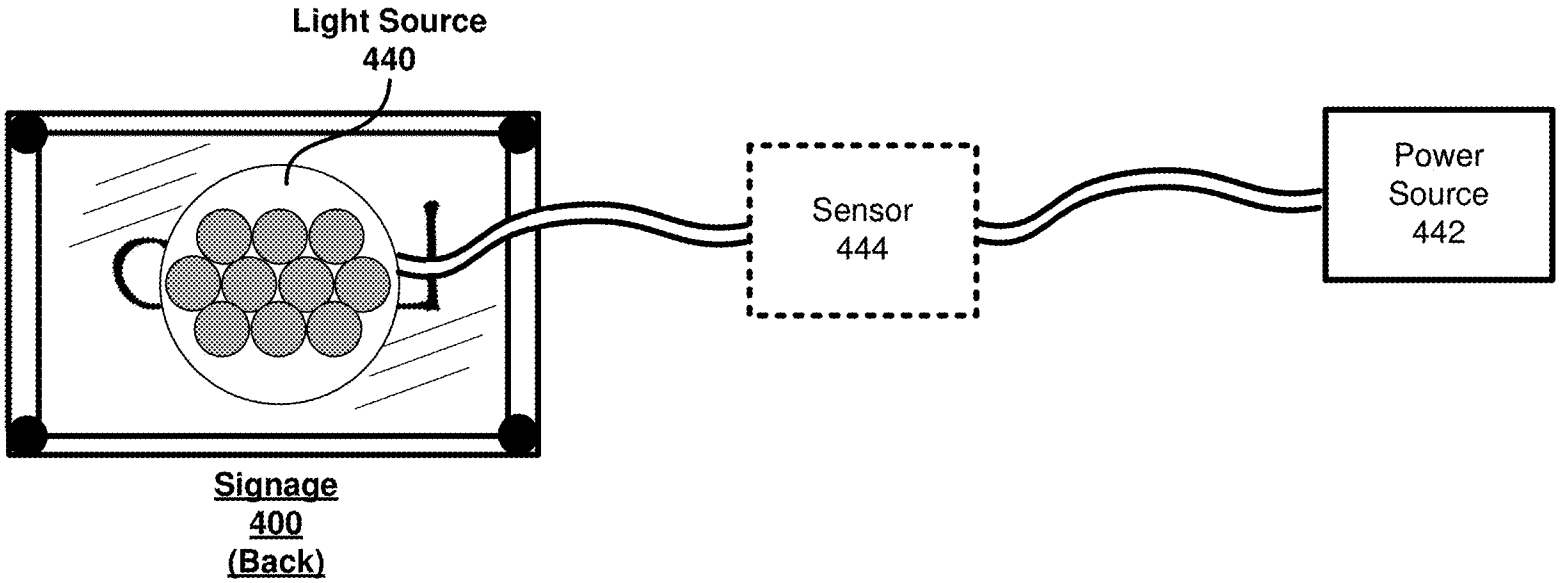
FIG. 6 illustrates an exemplary light source coupled to a sensor in accordance with an aspect of the subject specification.

Referring next to FIG. 6, an exemplary signage embodiment is provided which includes a particular light source mechanism in accordance with an aspect of the subject specification. As illustrated, a signage 400 is contemplated in which the signage 400 includes a light source 440 that may be coupled to a sensor 444 and power source 442. Within such embodiment, the sensor 444 may be configured to measure ambient light, and further configured to activate the light source 440 upon detecting that the ambient light is below a threshold (e.g., to detect a dusk-to-dawn period when ambient light is low).

Figure 7:
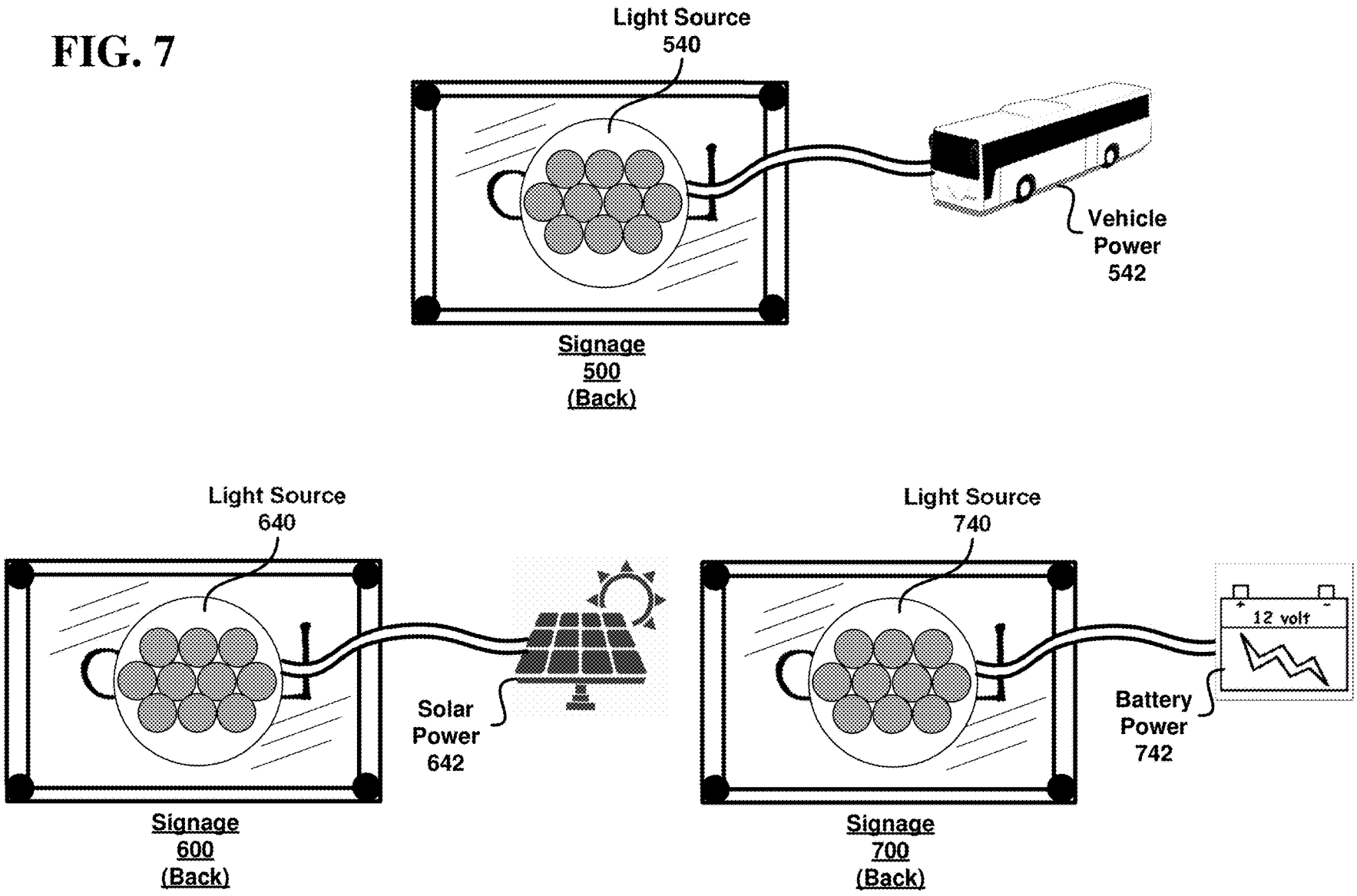
FIG. 7 illustrates a plurality of exemplary power source configurations in accordance with various aspects of the subject specification.

Referring next to FIG. 7, a plurality of exemplary power source configurations are illustrated in accordance with various aspects of the subject specification. As illustrated, a first exemplary embodiment is contemplated in which a signage 500 includes a light source 540 coupled to a vehicle power source 542 (e.g., where power is provided by vehicle 200). In another exemplary embodiment, a signage 600 is contemplated in which the signage 600 includes a light source 640 coupled to a solar power source 642 (e.g., where solar panels are located on the signage 600 or the vehicle 200). In yet another exemplary embodiment, a signage 700 is contemplated in which the signage 700 includes a light source 740 coupled to a portable battery power source 742 (e.g., a 12 volt battery).

Figure 8:
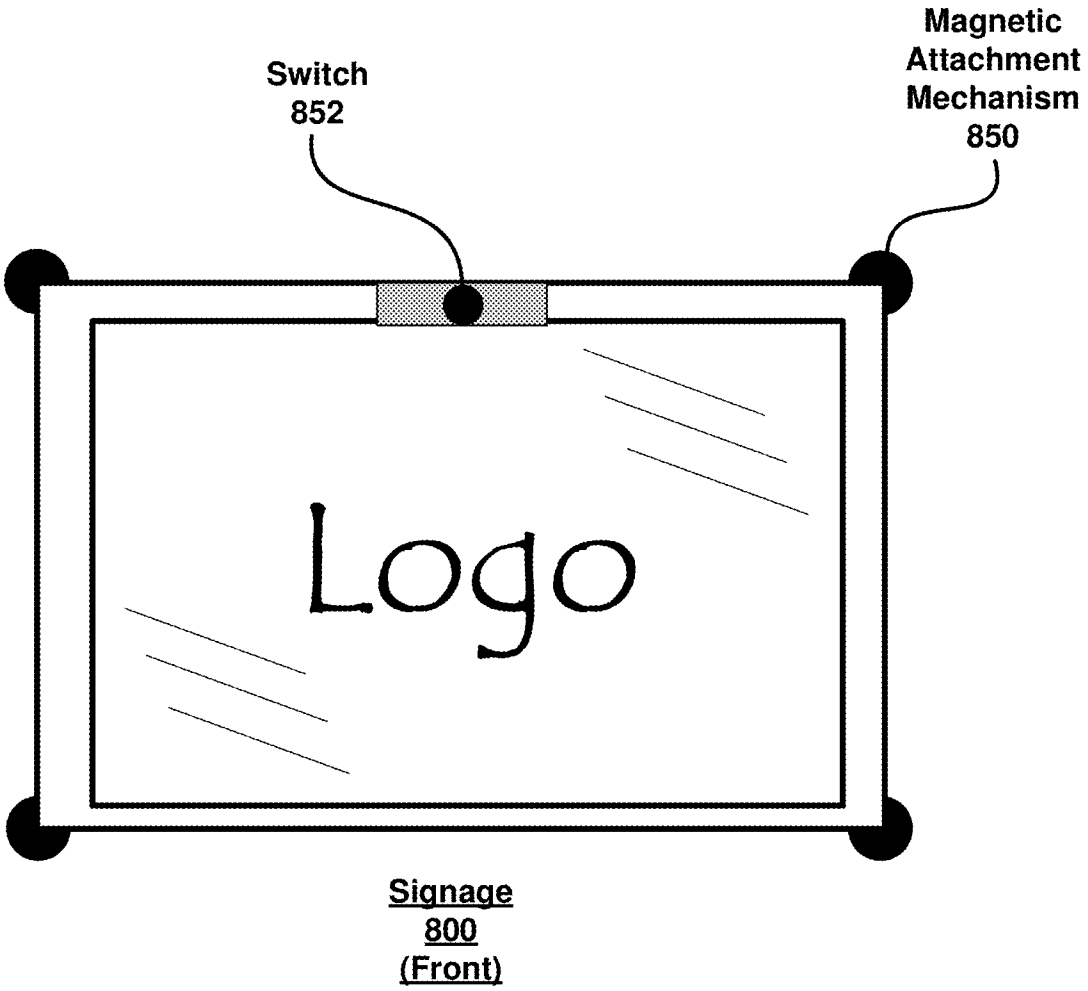
FIG. 8 illustrates an exemplary magnetic attachment mechanism in accordance with another aspect of the subject specification.

Referring next to FIG. 8, an exemplary signage embodiment is provided which includes a particular attachment mechanism in accordance with an aspect of the subject specification. As illustrated, a signage 800 is contemplated in which the signage 800 includes a magnetic attachment mechanism 850, wherein the magnetic attachment mechanism 850 may comprise an array of magnets having strong magnetic properties in order to more securely attach the signage 800 during transit (e.g., where the magnetic attachment mechanism comprises at least one rare-earth magnet).

Alternatively, in order to facilitate easy removal of the signage 800, it is contemplated that the magnetic attachment mechanism 850 may comprise at least one electropermanent magnet, wherein a switch 852 is configured to activate and deactivate a magnetic field of the at least one electropermanent magnet. Within such embodiment, it is further contemplated that the switch 852 may be coupled to a user interface which allows the user to enter security credentials to activate and deactivate the magnetic field. Such configuration might be desirable to avoid having the signage 800 stolen, for example, wherein the user interface may be any of a plurality of user interfaces known in the art (e.g., a keypad configured to receive an alphanumeric password, a biometric reader configured to perform a biometric reading, etc.).

The word "exemplary" is used herein to mean serving as an example, instance, or illustration. For the avoidance of doubt, the subject matter disclosed herein is not limited by such examples. In addition, any aspect or design described herein as "exemplary" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, for the avoidance of doubt, such terms are intended to be inclusive in a manner similar to the term "comprising" as an open transition word without precluding any additional or other elements.

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components coupled to other components rather than included within parent components (hierarchical). Additionally, it is noted that one or more components may be combined into a single component providing aggregate functionality or divided into several separate sub-components, and any one or more middle layers may be provided to couple to such sub-components in order to provide integrated functionality. Any components described herein may also interact with one or more other components not specifically described herein but generally known by those of skill in the art.

In view of the exemplary systems described supra, methodologies that may be implemented in accordance with the disclosed subject matter can be appreciated with reference to the various figures. While for purposes of simplicity of explanation, the methodologies are described as a series of steps, it is to be understood and appreciated that the disclosed subject matter is not limited by the order of the steps, as some steps may occur in different orders and/or concurrently with other steps from what is described herein. Moreover, not all disclosed steps may be required to implement the methodologies described hereinafter.

While the various embodiments have been described in connection with the exemplary embodiments of the various figures, it is to be understood that other similar embodiments may be used or modifications and additions may be made to the described embodiment for performing the same function without deviating there from. Therefore, the present invention should not be limited to any single embodiment.

What is claimed is:

1. A method, comprising:

attaching a signage to a vehicle via an attachment mechanism, wherein the signage includes:

a mica cover positioned within a perimeter of a frame, wherein a backside of the mica cover includes an etched logo comprising translucent ink; and a light source configured to direct light towards the backside of the mica cover; and transmitting light through the etched logo via the light source, wherein an illumination of the etched logo is viewable from a frontside of the mica cover.

2. The method according to claim 1, wherein the mica cover comprises polycarbonate material.

3. The method according to claim 1, wherein the transmitting comprises transmitting light via a light emitting diode (LED) light source.

4. The method according to claim 1, further comprising:

measuring ambient light via a sensor; and activating the light source upon detecting that the ambient light is below a threshold.

5. The method according to claim 1, further comprising providing power to the light source via a power source.

6. The method according to claim 5, wherein the power source is a 12 volt battery.

7. The method according to claim 5, wherein the power source is a solar power source.

8. The method according to claim 5, wherein the power source is a power source provided by the vehicle.

9. The method according to claim 1, wherein the attaching comprises attaching the signage via a magnetic mechanism.

10. The method according to claim 9, wherein the attaching comprises attaching the signage via at least one rare-earth magnet.

11. A method, comprising:

attaching a signage to a vehicle via a magnetic mechanism comprising a switch and at least one electropermanent magnet, wherein the switch is configured to activate a magnetic field of the at least one electropermanent magnet, and wherein the signage includes:

a mica cover positioned within a perimeter of a frame;

a light source configured to direct light towards a backside of the mica cover; and a logo component positioned on the backside of the mica cover; and transmitting light through the logo component via the light source, wherein the transmitting illuminates a logo on the logo component that is viewable from a frontside of the mica cover.

12. The method according to claim 11, wherein the mica cover comprises polycarbonate material.

13. The method according to claim 11, wherein the logo component is a transparency film positioned on the backside of the mica cover, and wherein the logo is printed on the transparency film.

14. The method according to claim 13, further comprising inserting the transparency film via a slot on a side of the frame.

15. The method according to claim 11, wherein the transmitting comprises transmitting light via a light emitting diode (LED) light source.

16. The method according to claim 11, further comprising:

measuring ambient light via a sensor; and activating the light source upon detecting that the ambient light is below a threshold.

17. A method, comprising:

attaching a signage to a vehicle via an attachment mechanism, wherein the signage includes:

a mica cover positioned within a perimeter of a frame; and a light source configured to direct light towards a backside of the mica cover; and a logo positioned on the backside of the mica cover; and transmitting light through the logo via the light source, wherein an illumination of the logo is viewable from a frontside of the mica cover.

18. The method according to claim 17, further comprising:

measuring ambient light via a sensor; and activating the light source upon detecting that the ambient light is below a threshold.

19. The method according to claim 17, wherein the attaching comprises attaching the signage via a magnetic mechanism comprising a switch configured to activate a magnetic field.

20. The method according to claim 17, wherein the logo comprises translucent ink.

* * * * *